US010079011B2

(12) United States Patent
Conkie

(10) Patent No.: US 10,079,011 B2
(45) **Date of Patent: *Sep. 18, 2018**

(54) SYSTEM AND METHOD FOR UNIT SELECTION TEXT-TO-SPEECH USING A MODIFIED VITERBI APPROACH

(71) Applicant: Nuance Communications, Inc., Burlington, MA (US)

(72) Inventor: Alistair D. Conkie, Morristown, NJ (US)

(73) Assignee: NUANCE COMMUNICATIONS, INC., Burlington, MA (US)

( * ) Notice: Subject to any disclaimer, the term of this patent is extended or adjusted under 35 U.S.C. 154(b) by 390 days.

This patent is subject to a terminal disclaimer.

(21) Appl. No.: 14/282,040

(22) Filed: May 20, 2014

(65) Prior Publication Data

US 2014/0257818 A1 Sep. 11, 2014

Related U.S. Application Data

(63) Continuation of application No. 12/818,835, filed on Jun. 18, 2010, now Pat. No. 8,731,931.

(51) Int. Cl.

| | |
|---|---|
| ***G10L 13/04*** | (2013.01) |
| ***G10L 13/06*** | (2013.01) |
| ***G10L 13/02*** | (2013.01) |
| ***G10L 13/07*** | (2013.01) |

(52) U.S. Cl.
CPC ..... *G10L 13/02* (2013.01); *G10L 13/04* (2013.01); *G10L 13/07* (2013.01); *G10L 13/06* (2013.01)

(58) Field of Classification Search
CPC ..... G10L 13/04; G10L 13/06; G10L 13/07
USPC .... 704/258, 260, 261, 266, E13.009, E13.01
See application file for complete search history.

(56) References Cited

U.S. PATENT DOCUMENTS 6,088,673 A * 7/2000 Lee ..... G10L 13/00 704/260
6,185,533 B1 * 2/2001 Holm ..... G10L 13/10 704/211
6,260,016 B1 * 7/2001 Holm ..... G10L 13/10 704/200

(Continued)

OTHER PUBLICATIONS

Raux, et al. "A unit selection approach to F0 modeling and its application to emphasis." Automatic Speech Recognition and Understanding, 2003. ASRU'03. 2003 IEEE Workshop on. IEEE, Dec. 2003, pp. 700-705.*

(Continued)

*Primary Examiner* — James Wozniak

(57) ABSTRACT

Disclosed herein are systems, methods, and non-transitory computer-readable storage media for speech synthesis. A system practicing the method receives a set of ordered lists of speech units, for each respective speech unit in each ordered list in the set of ordered lists, constructs a sublist of speech units from a next ordered list which are suitable for concatenation, performs a cost analysis of paths through the set of ordered lists of speech units based on the sublist of speech units for each respective speech unit, and synthesizes speech using a lowest cost path of speech units through the set of ordered lists based on the cost analysis. The ordered lists can be ordered based on the respective pitch of each speech unit. In one embodiment, speech units which do not have an assigned pitch can be assigned a pitch.

20 Claims, 6 Drawing Sheets

(56) References Cited

U.S. PATENT DOCUMENTS 6,505,158 B1 * 1/2003 Conkie ..... G10L 13/07 704/260
6,665,641 B1 * 12/2003 Coorman ..... G10L 13/07 704/258
6,988,069 B2 1/2006 Phillips
7,013,278 B1 * 3/2006 Conkie ..... G10L 13/07 704/260
7,139,712 B1 11/2006 Yamada
7,165,030 B2 1/2007 Yi et al.
7,460,997 B1 12/2008 Conkie
7,603,278 B2 * 10/2009 Fukada ..... G10L 13/06 345/473
7,689,421 B2 * 3/2010 Li ..... G10L 13/033 704/258
7,869,999 B2 1/2011 Amato et al.
7,979,280 B2 7/2011 Wouters et al.
7,983,919 B2 7/2011 Conkie
8,155,964 B2 * 4/2012 Hirose ..... G10L 13/033 704/260
8,321,222 B2 * 11/2012 Pollet ..... G10L 13/07 379/88.03
2002/0184032 A1 * 12/2002 Hisaminato ..... G10L 13/06 704/268
2003/0061051 A1 * 3/2003 Kondo ..... G10L 13/06 704/263
2005/0137871 A1 * 6/2005 Capman ..... G10L 19/0018 704/268
2006/0136213 A1 6/2006 Hirose et al.
2006/0259303 A1 11/2006 Bakis
2007/0073542 A1 * 3/2007 Chittaluru ..... G10L 13/047 704/260
2008/0082333 A1 * 4/2008 Nurminen ..... G10L 21/00 704/250
2008/0140407 A1 * 6/2008 Aylett ..... G10L 13/00 704/260
2008/0288256 A1 * 11/2008 Agapi ..... G10L 13/04 704/260
2008/0312931 A1 * 12/2008 Mizutani ..... G10L 13/06 704/260
2010/0312564 A1 * 12/2010 Plumpe ..... G10L 13/033 704/260
2010/0312565 A1 * 12/2010 Wang ..... G10L 13/00 704/260
2011/0246200 A1 * 10/2011 Song ..... G10L 13/07 704/260

OTHER PUBLICATIONS

Hon, H., et al. "Automatic generation of synthesis units for trainable text-to-speech systems." Acoustics, Speech and Signal Processing, 1998. Proceedings of the 1998 IEEE International Conference on. vol. 1. IEEE, May 1998, pp. 293-296.*

Zhao, Yong, et al. "Custom-tailoring TTS voice font-keeping the naturalness when reducing database size." Interspeech. Sep. 2003, pp. 2957-2960.*

Chu et al., "Modeling stylized invariance and local variability of prosody in text-to-speech synthesis", Speech Communication, 48.6 (2006) pp. 716-726.

Black et al., "Automatically clustering similar units for unit selection speech synthesis," in Proc Eurospeech, Rhodes, Greece, Sep. 1997, pp. 1-4.

Hunt et al., "Unit selection in a concatenative speech synthesis system using a large speech database." Acoustics, Speech and Signal Processing, 1996, ICASSP-96. Conference Proceedings, 1996 IEEE International Conference, vol. 1, May 1996, pp. 373-376.

Breen et al., "Using F0 within a phonologically motivated method of unit selection." 6$^{th}$ International Conference on Spoken Language Processing, ISCLP 2000, Beijing, China, Oct. 2000, pp. 1-4.

Conkie et al., "Using F0 to constrain the unit selection Viterbi network," Acoustics, Speech and Signal Processing (ICASSP), 2011 IEEE International Conference, May 22-27, 2011, pp. 5376-5379.

* cited by examiner

SYSTEM AND METHOD FOR UNIT SELECTION TEXT-TO-SPEECH USING A MODIFIED VITERBI APPROACH

PRIORITY

The present application is a continuation of U.S. patent application Ser. No. 12/818,835, filed Jun. 18, 2010, the content of which is incorporated herein by reference in its entirety.

BACKGROUND

1. Technical Field

The present disclosure relates to speech synthesis and more specifically to a more efficient approach to unit selection based speech synthesis.

2. Introduction

A number of practical questions must be addressed for unit selection to operate efficiently. Building and using a unit selection database requires storage and rapid manipulation of large quantities of data such as speech units and their associated metadata. Existing unit selection algorithms can be too slow for real time synthesis based on such large quantities of data. High quality speech databases have tens of thousands or more speech units of different sounds, pitches, speeds, durations, and so forth. The functional complexity of unit selection is $O(n^2)$ because each list of n speech units is compared to n other speech units.

The basic approach can be unworkable with high quality speech databases and is inefficient with lower quality speech databases, leading to extra processing, storage, and memory requirements for speech synthesis systems and/or reduced quality synthesized speech. One approach to accelerating the runtime calculation of a path through the unit selection network is join cost caching. For example, a large body of text can be synthesized and the costs associated with the units used can be cached to speed up synthesis, without an enormous space penalty. Another approach to this problem is preselection. Preselection assigns a context-based cost to individual units prior to calculating the complete target cost. The context-based cost is used for pruning the number of possible candidates, which may number several thousand for a particular phone type, down to a number which can be used efficiently in the network—perhaps tens or low hundreds.

Even with join cost caching or preselection, the number of candidate units for synthesis is often very large. Accordingly, what is needed in the art is a more efficient way to perform unit selection in speech synthesis systems.

SUMMARY

Additional features and advantages of the disclosure will be set forth in the description which follows, and in part will be obvious from the description, or can be learned by practice of the herein disclosed principles. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

This disclosure addresses a way to more efficiently calculate concatenation costs for unit selection. This approach makes certain assumptions about $f_0$ (or intrinsic pitch) distributions and can calculate the consequences in terms of concatenation choices. Based on the resulting distribution, this approach estimates which subset of possible concatenations are relevant, likely, and/or possible. This approach can identify the relevant concatenations by imposing an ordering constraint on candidate units based on their $f_0$ value. In one aspect, unit selection calculations are based on observations of patterns of units that emerge from existing unit selection implementations. The approach disclosed herein is faster, more efficient, and uses less memory as well as provides at least an incidental improvement in synthesis quality.

Disclosed are systems, methods, and non-transitory computer-readable storage media for performing speech synthesis. A first exemplary method includes receiving a set of ordered lists of speech units, for each respective speech unit in each ordered list in the set of ordered lists, constructing a sublist of speech units from a next ordered list which are suitable for concatenation, performing a cost analysis of paths through the set of ordered lists of speech units based on the sublist of speech units for each respective speech unit, and synthesizing speech using a lowest cost path of speech units through the set of ordered lists based on the cost analysis. A second exemplary method includes, in a text-to-speech synthesis system that uses unit selection, imposing ordering constraints on speech units, the ordering constraints indicating speech unit pairs which are suitable for concatenation based on a respective pitch of each speech unit, and, when performing unit selection to synthesize speech, considering speech unit pairs in which a difference in pitch is below a threshold value based on the imposed ordering constraints.

BRIEF DESCRIPTION OF THE DRAWINGS

In order to describe the manner in which the above-recited and other advantages and features of the disclosure can be obtained, a more particular description of the principles briefly described above will be rendered by reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

Figure 1:
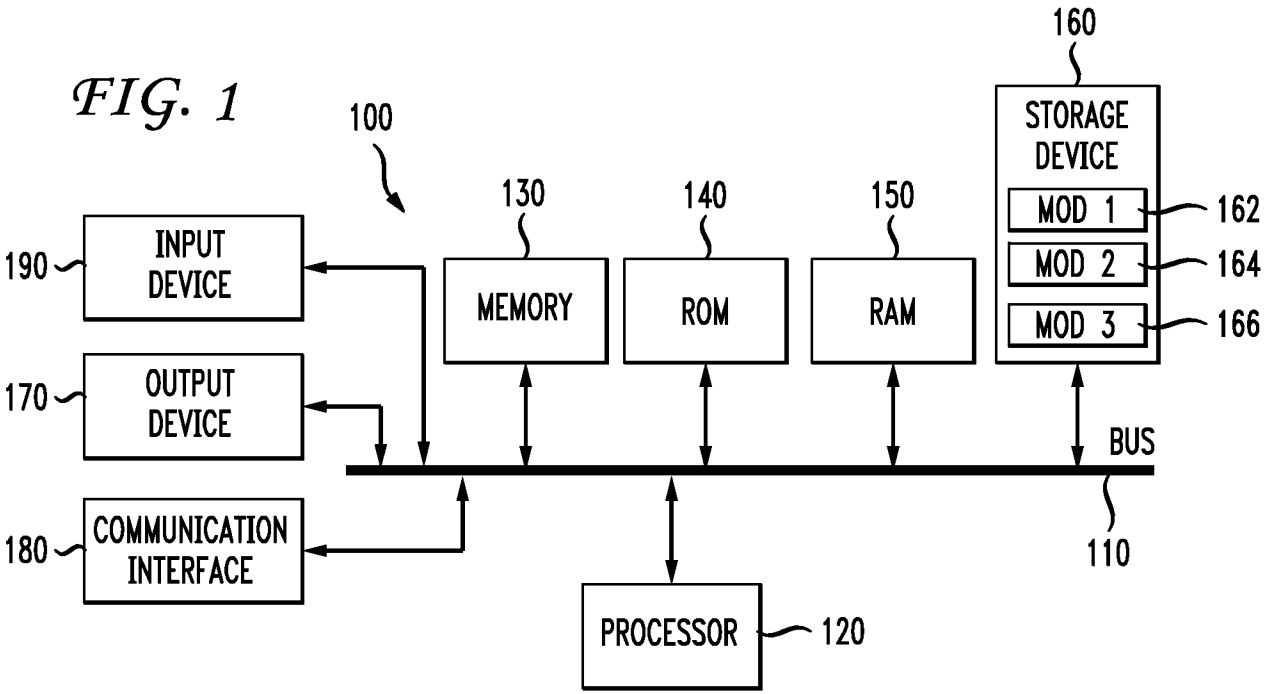
FIG. 1 illustrates an example system embodiment.

The present disclosure addresses the need in the art for more efficient calculation of costs when performing unit selection based speech synthesis. First the disclosure briefly discusses this approach at a high level. Next, a brief discussion of a basic general purpose system or computing device in FIG. 1 is disclosed which can be employed to practice the concepts disclosed herein. Then the disclosure turns to a general discussion of a speech recognition and synthesis system which can practice all or part of the principles disclosed herein. A more detailed description of methods and graphical interfaces will then follow.

The disclosure now turns to a brief discussion of efficient unit selection. Modern speech synthesizers frequently use unit selection and concatenative methods to generate audible speech. For example, a speech synthesizer can combine a first half of one "ah" speech unit with a second half of another "ah" speech unit to create part of a specific word. In order to sound natural, the two "ah" speech units typically have a pitch difference of 10 Hz or less, for example. A characteristic feature of unit selection and concatenation is a large inventory of recorded speech with multiple variants of units available for concatenation. Appropriate units for synthesis are selected at run time and the waveforms concatenated to make the desired synthetic utterance. The synthesis is generally very natural-sounding and of very high quality.

Figure 3:
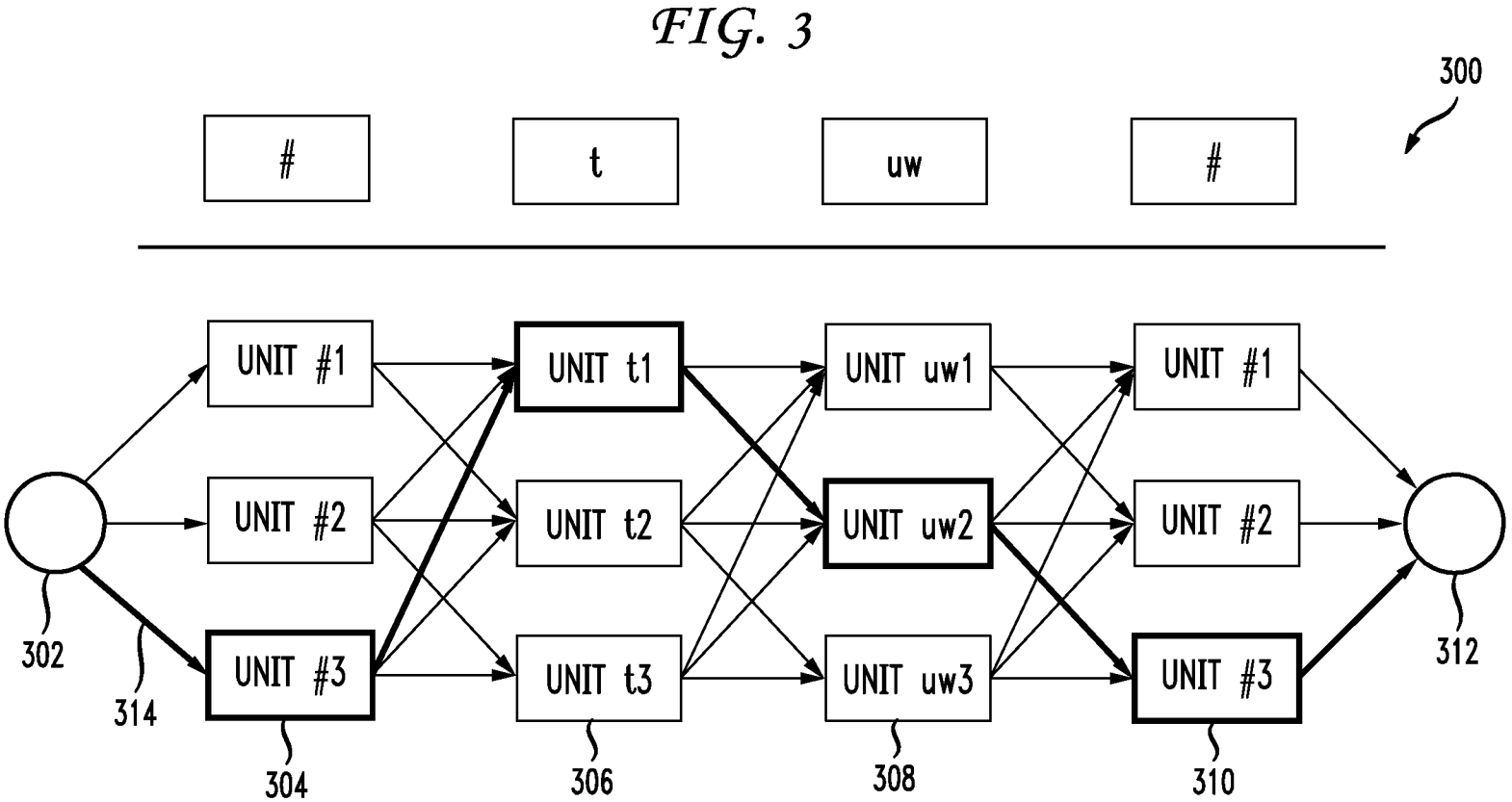
FIG. 3 illustrates an example network of speech units modeled as a network.

Some examples of speech units include phones, diphones, triphones, and half phones. Typically unit selection is modeled mathematically as a network with two cost functions. FIG. 3 illustrates the general form of the network 300. The network has a start state 302, multiple options for intermediate states 304, 306, 308, 310, and an end state 312. Each of the intermediate states includes multiple speech unit options, such as unit #1, unit #2, and unit #3 in the first intermediate state 304. The target cost measures how close (in terms of $f_0$, duration, and/or other parameters) an individual database unit is to the synthesis specification. The join cost is an estimate of the degree of perceived discontinuity between two units to be joined. The sequence of units 314 with the lowest overall cost (sum of target and join costs) is assumed to result in the best quality synthesis. This sequence of units is concatenated together to produce audio output. The more highly correlated the costs are to listener perception, the better the quality is likely to be.

A unit selection database consists of high fidelity recordings of continuous speech from a single speaker. It can consist of many thousands or even millions of units, and is a vital element in the development of a high quality unit selection synthesizer. The speech units in the database can include labels of a number of features such as phone identity, probability of voicing, $f_0$, and so forth. These and other variations shall be discussed herein as the various embodiments are set forth. The disclosure now turns to FIG. 1.

With reference to FIG. 1, an exemplary system 100 includes a general-purpose computing device 100, including a processing unit (CPU or processor) 120 and a system bus 110 that couples various system components including the system memory 130 such as read only memory (ROM) 140 and random access memory (RAM) 150 to the processor 120. The system 100 can include a cache of high speed memory connected directly with, in close proximity to, or integrated as part of the processor 120. The system 100 copies data from the memory 130 and/or the storage device 160 to the cache for quick access by the processor 120. In this way, the cache provides a performance boost that avoids processor 120 delays while waiting for data. These and other modules can be configured to control the processor 120 to perform various actions. Other system memory 130 may be available for use as well. The memory 130 can include multiple different types of memory with different performance characteristics. It can be appreciated that the disclosure may operate on a computing device 100 with more than one processor 120 or on a group or cluster of computing devices networked together to provide greater processing capability. The processor 120 can include any general purpose processor and a hardware module or software module, such as module 1 162, module 2 164, and module 3 166 stored in storage device 160, configured to control the processor 120 as well as a special-purpose processor where software instructions are incorporated into the actual processor design. The processor 120 may essentially be a completely self-contained computing system, containing multiple cores or processors, a bus, memory controller, cache, etc. A multi-core processor may be symmetric or asymmetric.

The system bus 110 may be any of several types of bus structures including a memory bus or memory controller, a peripheral bus, and a local bus using any of a variety of bus architectures. A basic input/output (BIOS) stored in ROM 140 or the like, may provide the basic routine that helps to transfer information between elements within the computing device 100, such as during start-up. The computing device 100 further includes storage devices 160 such as a hard disk drive, a magnetic disk drive, an optical disk drive, tape drive or the like. The storage device 160 can include software modules 162, 164, 166 for controlling the processor 120. Other hardware or software modules are contemplated. The storage device 160 is connected to the system bus 110 by a drive interface. The drives and the associated computer readable storage media provide nonvolatile storage of computer readable instructions, data structures, program modules and other data for the computing device 100. In one aspect, a hardware module that performs a particular function includes the software component stored in a non-transitory computer-readable medium in connection with the necessary hardware components, such as the processor 120, bus 110, display 170, and so forth, to carry out the function. The basic components are known to those of skill in the art and appropriate variations are contemplated depending on the type of device, such as whether the device 100 is a small, handheld computing device, a desktop computer, or a computer server.

Although the exemplary embodiment described herein employs the hard disk 160, it should be appreciated by those skilled in the art that other types of computer readable media which can store data that are accessible by a computer, such as magnetic cassettes, flash memory cards, digital versatile disks, cartridges, random access memories (RAMs) 150, read only memory (ROM) 140, a cable or wireless signal containing a bit stream and the like, may also be used in the exemplary operating environment. Non-transitory computer-readable storage media expressly exclude media such as energy, carrier signals, electromagnetic waves, and signals per se.

To enable user interaction with the computing device 100, an input device 190 represents any number of input mechanisms, such as a microphone for speech, a touch-sensitive screen for gesture or graphical input, keyboard, mouse, motion input, speech and so forth. An output device 170 can also be one or more of a number of output mechanisms known to those of skill in the art. In some instances, multimodal systems enable a user to provide multiple types of input to communicate with the computing device 100. The communications interface 180 generally governs and manages the user input and system output. There is no restriction on operating on any particular hardware arrangement and therefore the basic features here may easily be substituted for improved hardware or firmware arrangements as they are developed.

For clarity of explanation, the illustrative system embodiment is presented as including individual functional blocks including functional blocks labeled as a "processor" or processor 120. The functions these blocks represent may be provided through the use of either shared or dedicated hardware, including, but not limited to, hardware capable of executing software and hardware, such as a processor 120, that is purpose-built to operate as an equivalent to software executing on a general purpose processor. For example the functions of one or more processors presented in FIG. 1 may be provided by a single shared processor or multiple processors. (Use of the term "processor" should not be construed to refer exclusively to hardware capable of executing software.) Illustrative embodiments may include microprocessor and/or digital signal processor (DSP) hardware, read-only memory (ROM) 140 for storing software performing the operations discussed below, and random access memory (RAM) 150 for storing results. Very large scale integration (VLSI) hardware embodiments, as well as custom VLSI circuitry in combination with a general purpose DSP circuit, may also be provided.

The logical operations of the various embodiments are implemented as: (1) a sequence of computer implemented steps, operations, or procedures running on a programmable circuit within a general use computer, (2) a sequence of computer implemented steps, operations, or procedures running on a specific-use programmable circuit; and/or (3) interconnected machine modules or program engines within the programmable circuits. The system 100 shown in FIG. 1 can practice all or part of the recited methods, can be a part of the recited systems, and/or can operate according to instructions in the recited non-transitory computer-readable storage media. Such logical operations can be implemented as modules configured to control the processor 120 to perform particular functions according to the programming of the module. For example, FIG. 1 illustrates three modules Mod1 162, Mod2 164 and Mod3 166 which are modules configured to control the processor 120. These modules may be stored on the storage device 160 and loaded into RAM 150 or memory 130 at runtime or may be stored as would be known in the art in other computer-readable memory locations.

Figure 2:
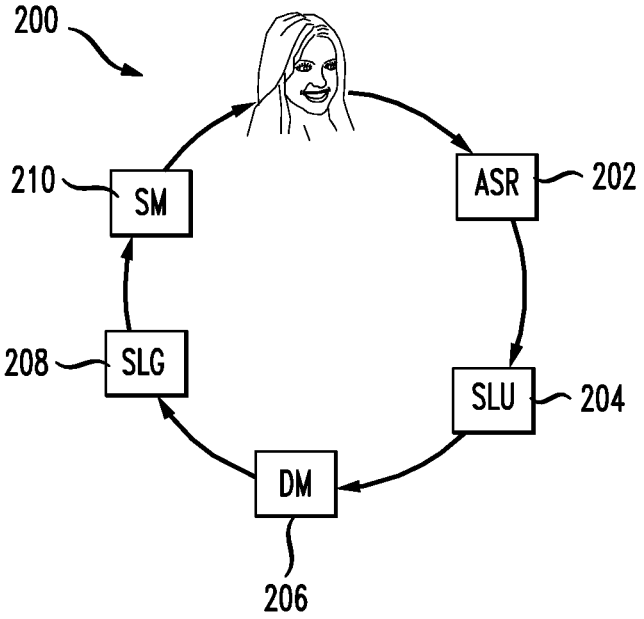
FIG. 2 illustrates a functional block diagram that illustrates an exemplary natural language spoken dialog system.

Having disclosed some basic system components, the disclosure now turns to the exemplary spoken dialog system as shown in FIG. 2. The spoken dialog system can be implemented in whole or in part using the exemplary system as shown in FIG. 1.

FIG. 2 is a functional block diagram that illustrates an exemplary natural language spoken dialog system which can incorporate all or part of the unit selection principles disclosed herein. Spoken dialog systems aim to identify intents of humans, expressed in natural language, and take actions accordingly, to satisfy their requests. Natural language spoken dialog system 200 can include an automatic speech recognition (ASR) module 202, a spoken language understanding (SLU) module 204, a dialog management (DM) module 206, a spoken language generation (SLG) module 208, and synthesizing module 210. The synthesizing module is unit-selection based. The present disclosure focuses on innovations related to the synthesizing module 210 and can also relate to other components of speech synthesis.

The ASR module 202 analyzes speech input and provides a textual transcription of the speech input as output. SLU module 204 can receive the transcribed input and can use a natural language understanding model to analyze the group of words that are included in the transcribed input to derive a meaning from the input. The role of the DM module 206 is to interact in a natural way and help the user to achieve the task that the system is designed to support. The DM module 206 receives the meaning of the speech input from the SLU module 204 and determines an action, such as, for example, providing a response, based on the input. The SLG module 208 generates a transcription of one or more words in response to the action provided by the DM 206. The synthesizing module 210 receives the transcription as input and provides generated audible speech as output based on the transcribed speech.

Thus, the modules of system 200 recognize speech input, such as speech utterances, transcribe the speech input, identify (or understand) the meaning of the transcribed speech, determine an appropriate response to the speech input, generate text of the appropriate response and from that text, generate audible "speech" from system 200, which the user then hears. In this manner, the user can carry on a natural language dialog with system 200. Those of ordinary skill in the art will understand the programming languages for generating and training ASR module 202 or any of the other modules in the spoken dialog system. Further, the modules of system 200 can operate independent of a full dialog system. For example, a computing device such as a smartphone (or any processing device having a phone capability) can include an ASR module wherein a user says "call mom" and the smartphone acts on the instruction without a "spoken dialog."

The disclosure now turns to a more detailed discussion of speech synthesis using a more efficient approach for unit selection. A unit selection approach to speech synthesis selects a string of speech units, such as phonemes or half-phones, and concatenates or joins them together to form words and phrases. The speech units are selected from a large database of indexed speech units. At run-time for unit selection, speech synthesis system receives incoming text and manipulates that text to output speech sounds in a particular pitch and duration, for example. The system examines the speech unit database and generates a list of candidate units, 50-100 candidates for example, for each individual position in the desired output. The system models the various proposed combinations of speech units and determines a target cost for the proposed combinations. The target cost can represent multiple factors. For example, the target cost can represent how much in isolation does the proposed combination look like what is desired, how well two candidates join, and other factors. The system makes a network or lattice of proposed combinations and selects the lowest cost sequence of units in the network or lattice. The system concatenates those speech units from the database to form output speech.

Observations show that speech units join in relatively few of the theoretically possible combinations. The solution described herein imposes at least one ordering constraint on the units considered as suitable for concatenation. One ordering constraint is the intrinsic pitch or $f_0$ of the units in question. With two ordered lists the range of pairs considered can be controlled in a straightforward manner. Only pairs of units where the delta or difference of $f_0$ is less than a threshold value need be considered. This is typically a much smaller subset of the entire set of speech units used in current approaches. Hence the overall cost calculation for a set of given proposed speech unit combinations requires fewer steps and can execute using less resources. This approach can be combined with other unit selection optimization techniques.

Concatenation costs approximate a human's perceptual judgments about how well the speech units being concatenated fit together. Relevant factors include abrupt changes in $f_0$, spectrum, and energy. For voiced sounds one possible measure is cross correlation. Anything more than Just Noticeable Differences (IND) will degrade quality to some degree. In a simple model of concatenation, consider the value of $f_0$ at the mid-point of each vowel in a large speech database. The range of Left Hand Side (LHS) $f_0$ values can be approximated by a Gaussian $N(\mu,\sigma^2)$, where $\mu$ is the mean value of $f_0$ and $\sigma$ is the standard deviation of $f_0$, both speaker dependent. The range of Right Hand Side (RHS) $f_0$ values will have an almost identical distribution. Now assume that the system can concatenate any LHS of a vowel of a particular type with any RHS of a vowel of the same type. The difference in $f_0$ across the boundary will form a distribution that is $N(0,2\sigma^2)$. The absolute value of the difference in $f_0$ is given by the half-normal distribution.

The cumulative distribution function is given by $$D(x) = \mathrm{erf}\left(\frac{x}{2\sigma}\right), x > 0,$$

where erf is the error function and x is in Hz. The distribution function has the property that there are relatively few values close to zero.

A small fraction of the possible combinations have a $\Delta f_0$ of less than 5 Hz. In other words, even given many candidates, only very few may provide acceptable joins for whatever $\Delta f_0$ is considered acceptable. With some caveats about signal modification that will be addressed shortly, this suggests that the choice of network paths is considerably limited when taking into account the $f_0$ component of concatenation cost calculations. At the same time, given that concatenation combinatorics are $O(n^2)$, any reduction in the number of joins to be calculated can lead to a significant performance increase. However, in order to realize a real-world performance benefit, the process of identifying relevant joins must be less expensive than just doing the calculations.

Signal modification is an effective method of avoiding perceptually jarring $f_0$ mismatches albeit at some cost in terms of naturalness. On the other hand, signal modification can permit a higher acceptable threshold for $\Delta f_0$ values across a join.

One goal of join cost caching is also to reduce the calculation load. Based on an analysis of a large body of synthesized text, the number of join costs needed for high quality synthesis is surprisingly small—around 1% of all possible join costs. The observations about $f_0$ values at joins seem to offer a plausible explanation for these results.

In summary, even given hundreds of candidates or more on each side of a join, only relatively few combinations produce acceptable joins. In the abstract case the number of acceptable joins is roughly proportional to $n^2$ where n is the number of candidates presented on each side of a join. These principles can be applied to voiced sounds as well as unvoiced sounds.

The disclosure now turns to one modified approach to concatenation cost calculations. This modified approach assumes that (1) if the number of join options is increased (by increasing the size of the database) the speech synthesis has better join choices and possibly higher quality synthesis, and (2) given that each speech unit generally tends to join with just a few others, the system can avoid a full set of concatenation cost calculations. One approach to (2) is to cache the data, but caching the data leaves open the question of efficiently using the cached data. Also cache building can be slow and cumbersome. The size of the cache can be quite large, and rebuilding the cache is required even for minor configuration changes, such as the inclusion of new material in the database. The approach disclosed herein focuses on (1) by structuring the unit selection and join cost calculations to reduce the complexity and number of calculations performed.

One way to achieve this is to order the candidate speech units based on $f_0$, or the fundamental frequency. $f_0$ is not the only relevant parameter, but it is dominant for concatenation in voiced regions. The candidate speech units can be ordered based on other parameters and can even be ordered based on multiple parameters. For example, if five speech units are tied on the $f_0$ parameter, the system can order those five speech units based on a secondary parameter. In another variation the speech units are ordered based on a sum of three parameters, for example.

Figure 4:
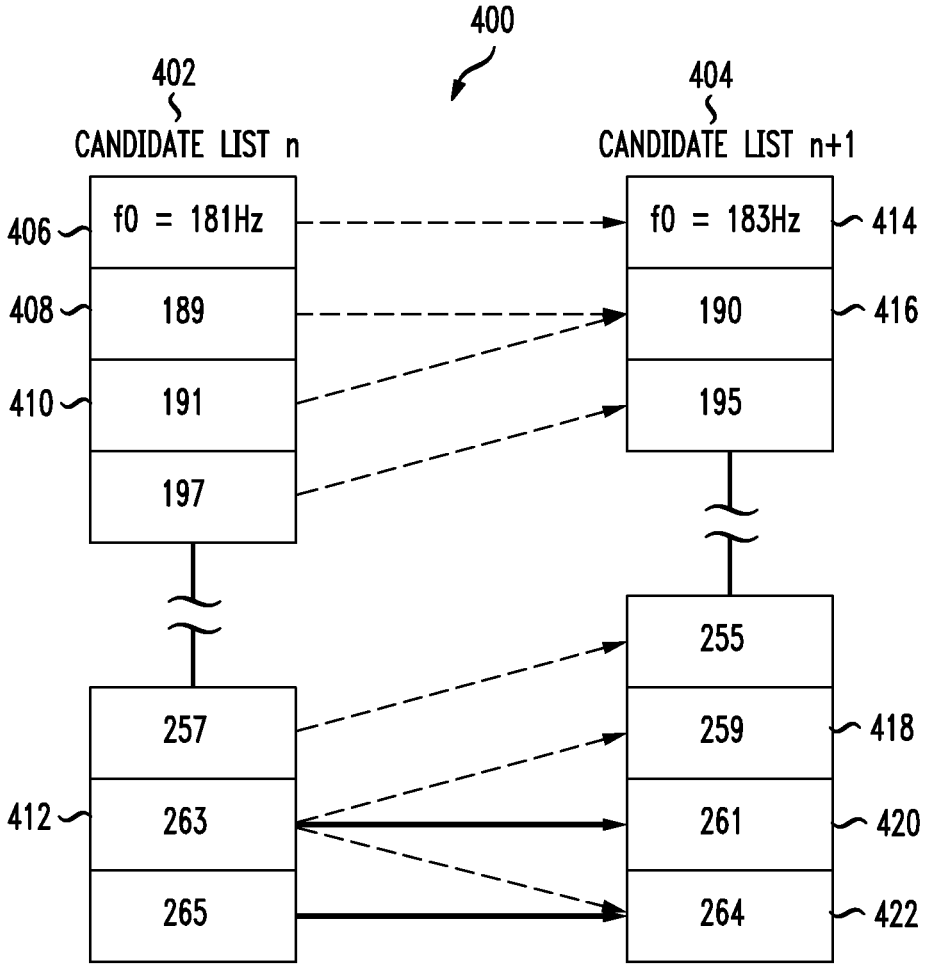
FIG. 4 illustrates a first exemplary ordered list of speech units and the sublists of speech units in a second ordered list of speech units corresponding to each speech unit in the first ordered list.

Two example approaches for ordering candidates are discussed below. These and other approaches also apply to unvoiced speech units. The first approach involves finding an average $f_0$ value for each speech unit, such as half phones, and using the speech unit $f_0$ values to order the speech units. One advantage of this approach is simplicity. Each unit list can be given a unique order prior to the calculation of the optimal path through the network 400, as illustrated in FIG. 4. The candidate list n 402 is on the left side and candidate list n+1 404 is on the right side.

Instead of a set of n×n concatenation costs associated with the basic approach, the concatenations are only calculated for the most relevant subset of candidates. As a simple example, assume both lists of candidates are of length 100, and that each candidate from the left list 402 only needs join to a maximum of 10 on the right list 404. In this case, the extra complexity of ordering the lists is inexpensive, O(n log n), and more than compensates for the calculation time required by reducing the number of join calculations by a factor of ten. In this example, speech unit 406 in the left list 402 can be joined with speech unit 414 in the right list 404 and calculations do not need to be performed with the remaining speech units in the right list 404. Similarly, speech unit 408 can be joined with speech unit 416, speech unit 410 can be joined with speech unit 416, and speech unit 412 can be joined with any of speech units 418, 420, 422. A single speech unit on the left side can map to one or more speech units on the right side, multiple speech units on the left side can map to a single speech unit on the right side, and multiple speech units on the left side can map to one or more of the same speech units on the right side. In most situations, the $\Delta f_0$ values for best path units are less than 50 Hz.

The approach can be enhanced by considering $f_0$ values at the leading and trailing edges of a unit. This necessitates a more complicated manipulation of list structures, but only a relatively small increase in complexity in the form of an additional list sort. The improved performance outweighs the increased computational complexity because the distribution of $\Delta f_0$ values at the boundaries is much narrower. In most cases $\Delta f_0$ is less than 10 Hz.

The system can also deal with unvoiced segments. In one variation, the system makes no special accommodation for unvoiced edges ($f_0$=0). In another variation, the system interpolates the $f_0$ contour across unvoiced segments so that every unit has at least a nominal $f_0$ value.

Large unit selection databases can be processed in a more computationally efficient way. Ordering candidate units provides a way to calculate a limited set of join costs including only plausible join candidates in a more efficient manner than with a standard Viterbi calculation. As long as the set of candidates is not too restricted, this partial calculation has a minimal impact on speech synthesis quality.

Figure 5:
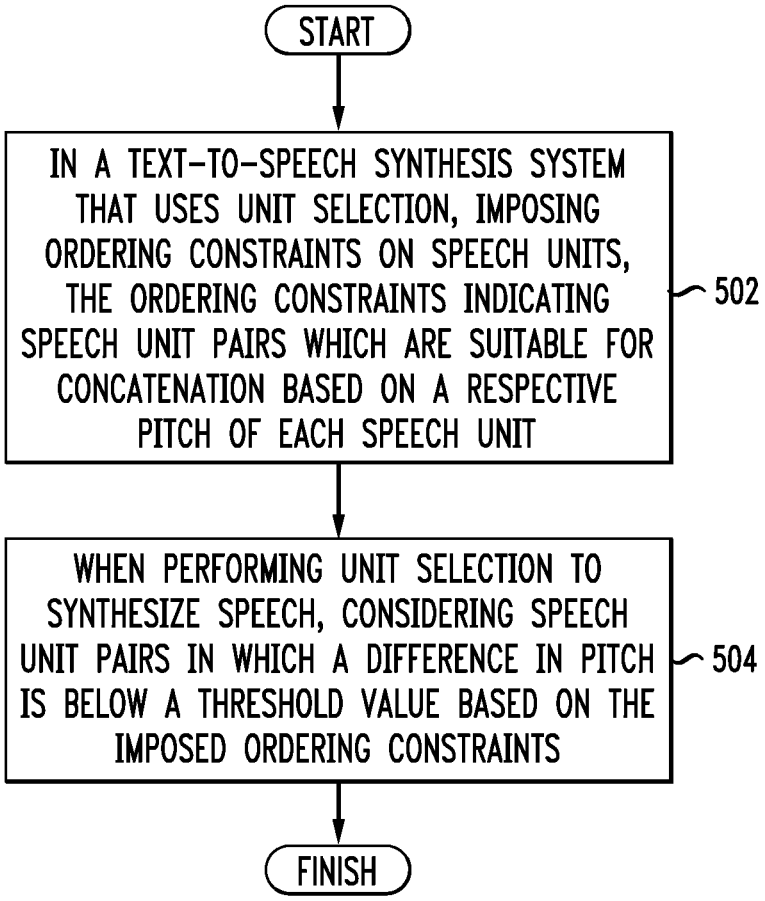
FIG. 5 illustrates a first example method embodiment.
Figure 6:
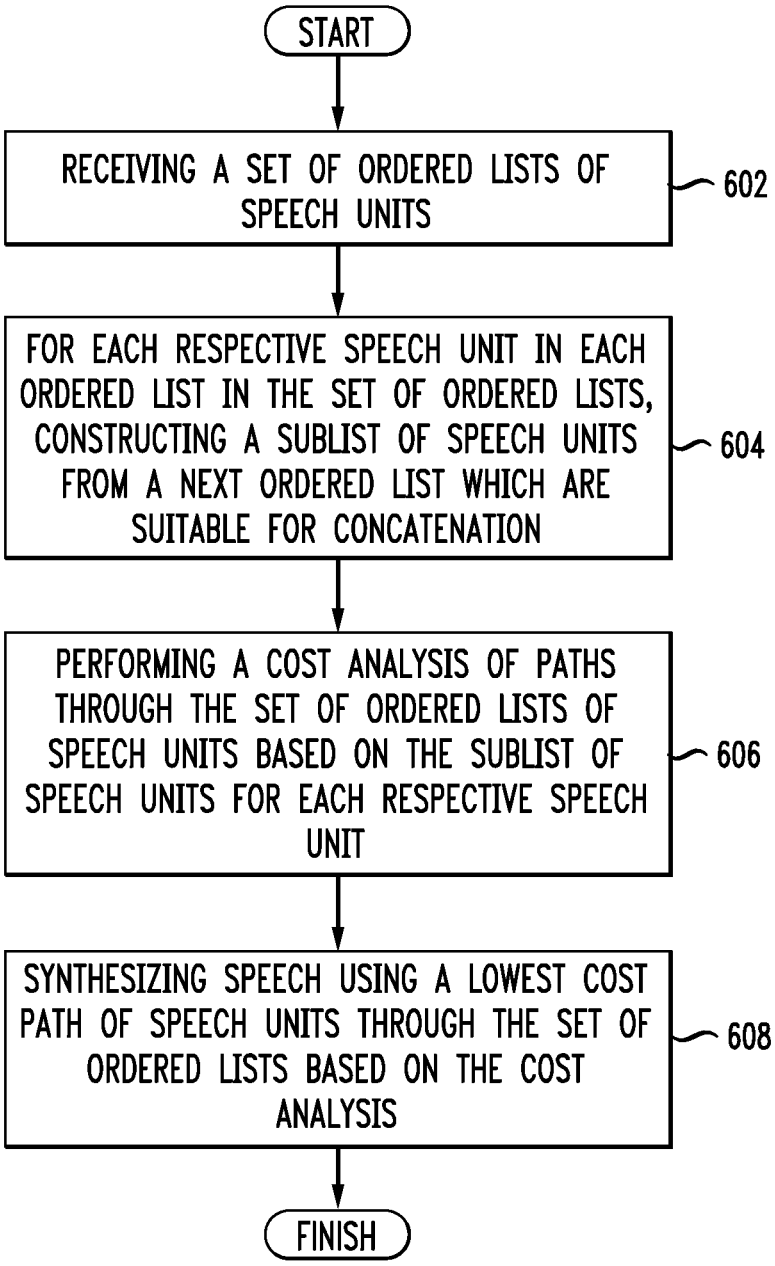
FIG. 6 illustrates a second example method embodiment.

Having disclosed some basic system components and concepts, the disclosure now turns to the exemplary method embodiment shown in FIGS. 5 and 6. For the sake of clarity, the methods are discussed in terms of an exemplary system as shown in FIG. 1 configured to practice the methods. FIG. 5 illustrates a first example method embodiment. A system 100 such as the one described in FIG. 1 can be configured to perform the method. The system 100 imposes ordering constraints on speech units in a text-to-speech synthesis system that uses unit selection (502). The ordering constraints indicate speech unit pairs which are suitable for concatenation based on a respective pitch of each speech unit. The system 100 can generate two ordered lists of speech units based on the respective pitch of each speech unit. The system 100 can assign a pitch to units which do not have an assigned pitch.

The system 100 considers speech unit pairs in which a difference in pitch is below a threshold value based on the imposed ordering constraints when performing unit selection to synthesize speech (504). The threshold value can be static or can be adjusted dynamically. For example, the system 100 may respond to temporarily high demands for processor time by lowering the threshold and decreasing the number of candidate speech units to process. Alternately, if the system 100 has unused available CPU cycles, cache, or memory, the system 100 can increase the threshold and devote those additional resources to processing more candidate speech units.

FIG. 6 illustrates a second example method embodiment. In this variation, the system 100 receives a set of ordered lists of speech units (602). As discussed above, the lists can be ordered by pitch, speed, duration, type of speech, metadata, and so forth. The system 100 constructs a sublist of speech units from a next ordered list which are suitable for concatenation for each respective speech unit in each ordered list in the set of ordered lists (604). For example, the sublist for a speech unit with a pitch of 197 Hz may be restricted to suitable speech units in the range of +/−4 Hz, or 193-201 Hz. The breadth of the range of Hz can vary up or down dynamically and/or on a per-user basis depending on desired quality, available processing power, user preferences, a quality of service agreement, and/or other factors.

The system 100 performs a cost analysis of paths through the set of ordered lists of speech units based on the sublist of speech units for each respective speech unit (606). One approach to performing a cost analysis is to generate a weighted lattice representing different paths through the candidate speech unit lists based on the sublists. The system 100 synthesizes speech using a lowest cost path of speech units through the set of ordered lists based on the cost analysis (608).

Embodiments within the scope of the present disclosure may also include tangible and/or non-transitory computer-readable storage media for carrying or having computer-executable instructions or data structures stored thereon. Such non-transitory computer-readable storage media can be any available media that can be accessed by a general purpose or special purpose computer, including the functional design of any special purpose processor as discussed above. By way of example, and not limitation, such non-transitory computer-readable media can include RAM, ROM, EEPROM, CD-ROM or other optical disk storage, magnetic disk storage or other magnetic storage devices, or any other medium which can be used to carry or store desired program code means in the form of computer-executable instructions, data structures, or processor chip design. When information is transferred or provided over a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, components, data structures, objects, and the functions inherent in the design of special-purpose processors, etc. that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described in such steps.

Those of skill in the art will appreciate that other embodiments of the disclosure may be practiced in network computing environments with many types of computer system configurations, including personal computers, hand-held devices, multi-processor systems, microprocessor-based or programmable consumer electronics, network PCs, mini-computers, mainframe computers, and the like. Embodiments may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

The various embodiments described above are provided by way of illustration only and should not be construed to limit the scope of the disclosure. Those skilled in the art will readily recognize various modifications and changes that may be made to the principles described herein without following the example embodiments and applications illustrated and described herein, and without departing from the spirit and scope of the disclosure.

I claim:

1. A method comprising:

selecting candidate speech units for converting text to speech;

ordering the candidate speech units according to a respective fundamental frequency of each candidate speech unit in the candidate speech units relative to all other fundamental frequencies in the candidate speech units, to yield a linear list of ordered candidate speech units;

constructing a sublist of the ordered candidate speech units, wherein a respective fundamental frequency of each candidate speech unit in the sublist is within a threshold distance of a respective proximate fundamental frequency associated with at least one candidate speech unit in a next linear list of ordered candidate speech units;

concatenating a proposed speech unit in the sublist with a chosen speech unit outside of the candidate speech units, to yield a concatenated speech unit; and synthesizing the speech using the concatenated speech unit.

2. The method of claim 1, wherein the respective fundamental frequency of each candidate speech unit comprises a leading edge frequency of the each candidate speech unit that is within the threshold distance of a trailing edge frequency of the proximate speech unit.

3. The method of claim 1, wherein the respective fundamental frequency of each candidate speech unit comprises a trailing edge frequency of the each candidate speech unit that is within the threshold distance of a leading edge frequency of the proximate speech unit.

4. The method of claim 1, further comprising adjusting the threshold distance based on a number of candidate speech units selected.

5. The method of claim 4, wherein the threshold distance is decreased when more candidate speech units are selected and increases when fewer candidate speech units are selected.

6. The method of claim 1, further comprising assigning a pitch to units which do not have an assigned pitch.

7. The method of claim 1, wherein respective fundamental frequency is a dominant one of multiple factors by which the ordered candidate speech units are ordered.

8. A system comprising:

a processor; and a computer-readable storage medium having instructions stored which, when executed by the processor, cause the processor to perform operations comprising:

selecting candidate speech units for converting text to speech;

ordering the candidate speech units according to a respective fundamental frequency of each candidate speech unit in the candidate speech units relative to all other fundamental frequencies in the candidate speech units, to yield a linear list of ordered candidate speech units;

constructing a sublist of the ordered candidate speech units, wherein a respective fundamental frequency of each candidate speech unit in the sublist is within a threshold distance of a respective proximate fundamental frequency associated with at least one candidate speech unit in a next linear list of ordered candidate speech units;

concatenating a proposed speech unit in the sublist with a chosen speech unit outside of the candidate speech units, to yield a concatenated speech unit; and synthesizing the speech using the concatenated speech unit.

9. The system of claim 8, wherein the respective fundamental frequency of each candidate speech unit comprises a leading edge frequency of the each candidate speech unit that is within the threshold distance of a trailing edge frequency of the proximate speech unit.

10. The system of claim 8, wherein the respective fundamental frequency of each candidate speech unit comprises a trailing edge frequency of the each candidate speech unit that is within the threshold distance of a leading edge frequency of the proximate speech unit.

11. The system of claim 8, the computer-readable storage medium having additional instructions stored which result in operations comprising adjusting the threshold distance based on a number of candidate speech units selected.

12. The system of claim 11, wherein the threshold distance is decreased when more candidate speech units are selected and increases when fewer candidate speech units are selected.

13. The system of claim 8, the computer-readable storage medium having additional instructions stored which result in operations comprising assigning a pitch to units which do not have an assigned pitch.

14. The system of claim 8, wherein respective fundamental frequency is a dominant one of multiple factors by which the ordered candidate speech units are ordered.

15. A computer-readable storage device having instructions stored which, when executed by a computing device, cause the computing device to perform operations comprising:

selecting candidate speech units for converting text to speech;

ordering the candidate speech units according to a respective fundamental frequency of each candidate speech unit in the candidate speech units relative to all other fundamental frequencies in the candidate speech units, to yield a linear list of ordered candidate speech units;

constructing a sublist of the ordered candidate speech units, wherein a respective fundamental frequency of each candidate speech unit in the sublist is within a threshold distance of a respective proximate fundamental frequency associated with at least one candidate speech unit in a next linear list of ordered candidate speech units;

concatenating a proposed speech unit in the sublist with a chosen speech unit outside of the candidate speech units, to yield a concatenated speech unit; and synthesizing the speech using the concatenated speech unit.

16. The computer-readable storage device of claim 15, wherein the respective fundamental frequency of each candidate speech unit comprises a leading edge frequency of the each candidate speech unit that is within the threshold distance of a trailing edge frequency of the proximate speech unit.

17. The computer-readable storage device of claim 15, wherein the respective fundamental frequency of each candidate speech unit comprises a trailing edge frequency of the each candidate speech unit that is within the threshold distance of a leading edge frequency of the proximate speech unit.

18. The computer-readable storage device of claim 15, having additional instructions stored which result in operations comprising adjusting the threshold distance based on a number of candidate speech units selected.

19. The computer-readable storage device of claim 18, wherein the threshold distance is decreased when more candidate speech units are selected and increases when fewer candidate speech units are selected.

20. The computer-readable storage device of claim 15, having additional instructions stored which result in operations comprising assigning a pitch to units which do not have an assigned pitch.

* * * * *